US012582215B1

(12) United States Patent
Lewis et al.

(10) Patent No.: US 12,582,215 B1
(45) Date of Patent: Mar. 24, 2026

(54) HOT HAIR STYLING APPLIANCE HOLDER

(71) Applicant: Innov8ive Werks LLC, Middletown, DE (US)

(72) Inventors: Walter Ernest Lewis, Newark, DE (US); Brent Walter Lewis, Middletown, DE (US); Kimberly Megan Haas, Newark, DE (US)

(73) Assignee: Innov8ive Werks LLC, Middletown, DE (US)

( * ) Notice: Subject to any disclaimer, the term of this patent is extended or adjusted under 35 U.S.C. 154(b) by 0 days.

(21) Appl. No.: 19/381,064

(22) Filed: Nov. 6, 2025

Related U.S. Application Data

(60) Provisional application No. 63/721,532, filed on Nov. 17, 2024.

(51) Int. Cl.
*A45D 44/02* (2006.01)

(52) U.S. Cl.
CPC ..... *A45D 44/02* (2013.01); *A45D 2200/152* (2013.01)

(58) Field of Classification Search
CPC .... A45D 44/02; A45D 2200/152; A45D 1/00; A45D 44/06; A45D 20/14; A45D 20/12
USPC ..... 248/226.11, 117.1–117.7
See application file for complete search history.

(56) References Cited

U.S. PATENT DOCUMENTS 1,502,385 A * 7/1924 Hauenstein ..... F21V 21/10 362/410
3,215,815 A * 11/1965 Lerner ..... B23K 3/027 248/176.1
3,294,348 A * 12/1966 Cerisano ..... B23K 3/027 248/176.1
D243,559 S * 3/1977 Hoyle ..... D28/38
4,446,972 A * 5/1984 Sussman ..... A47G 29/08 211/60.1
4,570,792 A 2/1986 Conway
4,660,610 A 4/1987 McIntire, III
D293,651 S * 1/1988 Aeschliman ..... 248/314
4,746,090 A * 5/1988 Hamilton ..... A45D 20/16 248/314
D305,944 S * 2/1990 Mellott ..... D11/146
4,973,019 A * 11/1990 Baird ..... A45D 1/00 D28/38
5,090,649 A * 2/1992 Tipp ..... A45D 1/00 248/176.2
5,141,189 A 8/1992 Andrew
D329,304 S * 9/1992 Tipp ..... D28/38
(Continued)

*Primary Examiner* — Muhammad Ijaz
(74) *Attorney, Agent, or Firm* — Rogowski Law LLC

(57) ABSTRACT

A hair appliance holder receives and retains the hot end of a hair appliance, such as a curling iron, into a cup shaped liner made of an insulating material that is held within a surrounding housing. The outer surface(s) of the liner are spaced apart from the inner surface(s) of the housing. Holes in a bottom portion of the liner communicate with vent opening(s) in a bottom wall of the housing. Air flows into the vent opening(s) of the housing, through the holes into the inner volume of the liner and exits from the top opening of the liner. Air from the vent opening(s) also flows through a gap between the housing and the liner to insulate the housing from the liner and direct heat out of the housing. Elongated ribs may project from the inner sidewall surface(s) and into the inner volume of the liner to define air flow passageways surrounding the hot hair appliance.

19 Claims, 5 Drawing Sheets

(56) References Cited

U.S. PATENT DOCUMENTS

D342,585 S * 12/1993 Fischbach ..... D28/38
5,577,607 A 11/1996 Drake et al.
5,743,415 A * 4/1998 Smart ..... A45D 20/12 248/314
6,123,299 A * 9/2000 Zach, Sr. ..... A45D 1/00 248/314
6,305,388 B1 * 10/2001 Zeller ..... A45D 44/02 132/287
6,601,813 B1 * 8/2003 Kager ..... F16M 13/00 248/314
D495,090 S * 8/2004 Schoening ..... D28/38
7,793,796 B1 * 9/2010 Evans ..... A45D 8/002 221/277
8,430,241 B1 4/2013 Balogh
D682,469 S 5/2013 Balogh
8,434,615 B2 5/2013 Balogh
8,689,999 B2 * 4/2014 Cooper ..... A45D 44/04 206/823
D711,043 S * 8/2014 Cooper ..... D28/38
8,851,304 B2 * 10/2014 Alexander ..... A45D 1/00 211/60.1
9,095,197 B2 * 8/2015 Rizzuto ..... A45D 1/20
10,743,633 B2 * 8/2020 Cooper ..... A45C 11/00
11,000,105 B2 * 5/2021 Howard ..... A45D 20/12
2003/0222069 A1 * 12/2003 Sena ..... A45D 20/12 219/222
2007/0284272 A1 * 12/2007 Rosdal ..... B65D 85/20 206/349
2008/0308695 A1 * 12/2008 Lambert ..... A47G 7/044 248/226.11
2010/0108827 A1 * 5/2010 Teraoka ..... B23K 3/027 248/117.2
2011/0133572 A1 * 6/2011 Levi ..... A45D 20/14 307/139
2013/0289536 A1 * 10/2013 Croizat ..... F16B 2/22 248/217.4
2014/0097313 A1 * 4/2014 Hesketh ..... A61G 7/0503 248/226.11
2020/0268123 A1 * 8/2020 Howard ..... A45D 20/12
2023/0240433 A1 * 8/2023 Boatman-Tate ..... A45D 44/02 132/200
2024/0251924 A1 * 8/2024 Dente ..... A45D 20/12
2024/0277132 A1 * 8/2024 Brown ..... A45F 3/005
2025/0197063 A1 * 6/2025 Gallo ..... A47K 1/09

* cited by examiner

HOT HAIR STYLING APPLIANCE HOLDER

CROSS-REFERENCE TO RELATED APPLICATION

This application claims priority under 35 USC § 119 (e) to U.S. Provisional Application Ser. No. 63/721,532, entitled "Hot Curling Iron Holder", filed Nov. 17, 2024, the disclosure of which is incorporated by reference herein.

TECHNICAL FIELD

The present invention is generally directed to a holder for safely retaining and storing electric heated hair styling appliances, such as hair curling irons, whether such appliances are hot or at room temperature.

BACKGROUND

Heated hair-styling appliances, include, without limitation, curling irons, straightening or flattening irons, hot styling brushes sometimes called blowout brushes, and other stylers such as hair dryers. These appliances generally are heated to high temperatures by electric resistance heating and will remain hot to the touch even after the appliance is unplugged. Sometimes multiple users may wish to use the heated hair-styling appliance before cooling the appliance to room temperature for storage. Accordingly, holders or stands upon which to place the hot hair-styling appliances are needed. Most holders for these devices are made of metal or silicone and when used become hot to the touch and increase the risk of a possible burn if the holder is contacted or touched by the user.

Many of the heated hair-styling appliances are operated in small bathrooms or other confined spaces, such as in recreational vehicles (RVs), or in shared spaces, such as dorm rooms. In many instances, there is limited counter space on which a holder or a stand for a hot hair-styling appliance to be placed or upon which the hot hair-styling appliance may rest. Hot hair-styling appliances will burn skin and may mar or damage surfaces of furniture or countertops with which they come into contact.

Different holders or caddies for storing hair-styling appliances have been proposed. U.S. Pat. No. 8,430,241 B1—Hair-Appliance Holder shows a silicone pouch that may be appended with a strap and a suction cup to the surface of a pedestal sink. The silicone pouch retains the heated end of the curling iron or other heated hair-styling appliance.

U.S. Pat. No. 8,689,999 B2—Hair Styling Device Holster shows a storage unit with multiple compartments adapted to receive hair styling appliances. The outer wall of the middle section of the storage unit may comprise metal mesh grating for air circulation.

U.S. Pat. No. 10,743,633 B2—Dual Function Hair Styling Tool Holder shows a two-part hinged case onto which, when in the open configuration, the end of a hot curling iron may be placed while heating. Spines on the surface of the case create an air gap and the spines absorb heat from the curling iron. In the closed configuration, the case may hold the room temperature curling iron therein for storage.

Improvements for storing hot hair-styling appliances continue to be sought.

SUMMARY

A hair appliance holder has at least one cup shaped liner that is adapted to receive the heated end of the hair appliance. Exemplary hair appliances include: a curling iron, a hair straightener, a styling iron, a blowout brush, a hair waver and a hair dryer. The cup shaped liner has a sidewall with an inner surface and an outer surface, a flange protruding or extending outward from a top portion of the sidewall, and a bottom wall. The bottom wall defines two or more holes therethrough establishing fluid flow (e.g., air flow) communication into an internal volume of the cup shaped liner.

A housing surrounds the cup shaped liner or liners. The housing has at least one housing sidewall and a housing bottom wall. The housing sidewall has an inner surface and an outer surface and the inner surface is spaced apart from the outer surface of at least one cup shaped liner creating a fluid receiving space, which can be one continuous channel if the outer surface of the liner is flat or substantially flat, or can be more than one fluid channel if the outer surface of the liner is textured or shaped to form fluid channels The housing bottom wall defines at least one vent opening sufficiently aligned with at least one of the two or more holes of the cup shaped liner to define a fluid passage into the internal volume of the cup shaped liner. The housing bottom wall defines at least one other vent opening sufficiently aligned with the fluid receiving space between the outer surface of the cup shaped liner and the inner surface of the housing sidewall to define a second fluid passage. A lid overlies on top of the sidewall of the housing, the lid defines an opening to receive the cup shaped liner, and the flange of the cup shaped liner seats over at least a portion of the lid extending over the sidewall. The lid extends past the outer surface of the housing and defines one or more vent openings communicating with the second fluid passage. Alternatively, the housing sidewall has one or more vent openings communicating with the second fluid passage, which vent openings are located below the lid. The fluid passages are configured to receive fluid (e.g. air) that flows through the vent openings and into the holder. The fluid (e.g. air) exits from the holder through the top opening of the cup shaped liner and through the vent openings defined in the lid or surrounding the lid or in the housing sidewall.

In one advantageous embodiment, a plurality of ribs project from the inner surface of the cup shaped liner and establish fluid flow channels therebetween. The at least one vent opening in the housing is sufficiently aligned with at least one of the two or more holes of the cup shaped liner to define a fluid passage communicating with at least some of the fluid flow channels between the ribs.

In another advantageous embodiment, a plurality of ribs project from the outer surface of the cup shaped liner and establish fluid flow channels therebetween. The at least one vent opening in the housing is sufficiently aligned with the fluid receiving space between the outer surface of the cup shaped liner and the inner surface of the housing sidewall to define a fluid passage communicating with at least some of the fluid flow channels between the ribs.

The cup shaped liner is formed of a high heat resistant insulative material. Exemplary high heat resistant insulative materials are silicone, silicone rubber, fiberglass, and ceramic. The housing is formed from a sturdy material suitable to retain the liner and the heated hair appliances therein. Exemplary materials for the housing are silicone, plastic, metal and wood, or combinations of these materials.

The holder can be of a type that includes a mounting feature to removably clamp the holder to a surface. The mounting feature is either integrally formed with the housing or is removably attachable to the housing. If the mounting feature comprises a clamp, the mounting feature has opposing clamp plates (or clamp jaws) with clamp plate surfaces. In an advantageous embodiment, the clamp plate surfaces are covered with or coated with a nonslip surface that inhibits marring the support surface to which the clamp is secured. One representative nonslip surface is formed with an adhesive backed urethane resilient pad applied to the clamp plate surfaces.

The holder can be of a type that stands or rests atop a horizontal support surface, such as a countertop or tabletop. For this configuration of the holder, legs extend from the housing bottom wall. The legs support the holder on the horizontal surface and establish an airspace between the bottom of the housing and the horizontal surface allowing proper fluid flow to the vents. In an advantageous embodiment, the housing bottom wall is supported by a base and the legs extend from the base. Exemplary base materials are plastic, ceramic, metal and wood. The base also may be formed of a high heat resistant insulative material.

Optionally, a force induction module, such as a fan or blower, may be provided to force fluid flow into one or more of the vent openings defined by the housing.

The holder can be of a type that includes a mounting feature to removably attach the holder to a vertical surface. The mounting feature for attaching the housing to a vertical surface may be integrally formed with the housing or may be removably attachable to the housing. In an advantageous embodiment, in addition to the mounting feature, legs extend from the housing bottom wall or side wall to permit the holder also to stand or rest atop a horizontal support surface, such as a countertop or tabletop.

We have identified at least the following advantages for our hot curling iron holder. Most holders for hot hair appliances are made of metal or silicone, and when used, become hot to the touch and increase the risk of a possible burn if the holder is contacted or touched by the user. Our preferred curling iron holder employs a liner made of silicone, which is well known to handle the high temperature without degrading or melting or deforming, and also exhibits low thermal conductivity. Our holder utilizes a gap between the liner and the housing that allows fluid (such as room air) to isolate the housing from the liner. This keeps the exterior of the housing cooler, and allows the user to handle or touch the housing of the holder even when the curling iron stored in the holder is hot. This holder structure allows a user to safely hold or store the curling iron while in use in a safe manner, and concurrently prevents the hot curling iron from being knocked off the counter or accidentally tugged by the cord that typically would be dangling off the counter or table. The integrated clamp allows for use in areas with limited counter space. The holder in the embodiment with the integrated clamp may be attached to surfaces sensitive to heat of the curling iron, because the clamp and housing isolate the curling iron from the mounting surface. Further advantages to ensure the holder remains cool to the touch are based on designed features utilized to allow air flow based on convective cooling for effective isolation of the outer housing from the curling iron. These features provide a significant advantage for both use and protection to the user.

The holder can be deployed and used in many locations, even locations with limited space, such as within RV's, boats, hotels, etc. The holder can be made with cost-effective materials allowing for a more appealing solutions and countless aesthetic design options.

The holders described in this application can easily be mounted to the tabletop via an integrated clamping mechanism. The holder provides a place in which the hot iron can be stored while the user goes about prepping and curling their hair. The compact, attractive holder contains the curling iron and shields the user and nearby persons from unintentional contact with the hot surface of the curling iron. This allows the holder to be detachably mounted for use in multiple places as needed to support someone who may want to engage in hair styling in different venues or locations with limited available surface space to place a curling iron while in use. The holder may be used with minimal concern or risk that the holder or the heated hair appliance stored in the holder will cause damage to a typical countertop surface. For the configuration of the holder with clamping mechanism, the holder is not just portable but simple to clamp to any horizontal surface with an exposed protruding edge. The integrated air channel between the liner and housing provides the necessary isolation to enable the holder to provide a safe means to protect the user and surfaces near the hot curling iron.

To summarize, the holder safely retains the hot hair curling iron so that the hot surface(s) thereof do not touch countertops, furniture or wall surfaces to which the holder is attached or on which the holder is supported, while also permitting the user to contact or hold exterior surfaces of the holder without incurring a burn or injury.

BRIEF DESCRIPTION OF THE DRAWINGS

The foregoing summary, as well as the following detailed description of the disclosure, will be better understood when read in conjunction with the appended drawings. For the purpose of illustrating the disclosure, there is shown in the drawings embodiments of holders for heated hair styling appliances that are presently preferred. It should be understood, however, that the disclosure is not limited to the precise arrangements and instrumentalities shown.

In the drawings.

DETAILED DESCRIPTION

Figure 1:
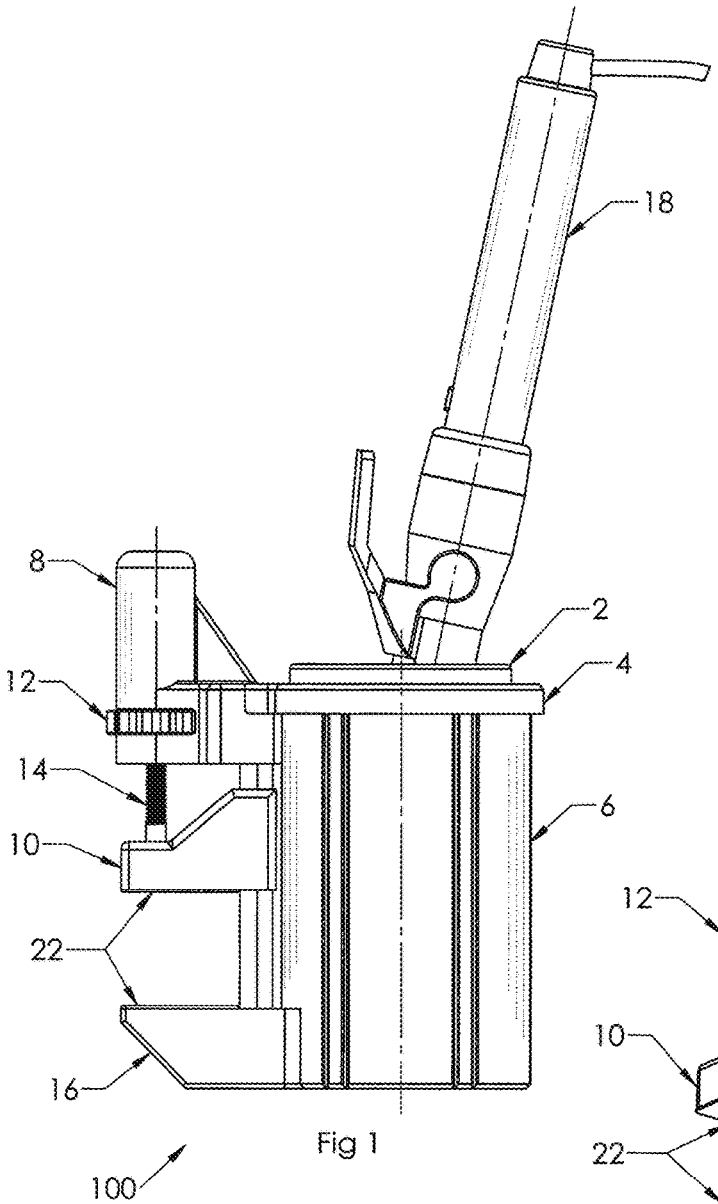
FIG. 1 is a left side view of a first embodiment of a holder for a hair styling appliance, with a curling iron positioned therein, said first embodiment incorporating a clamp so that the holder may be clamped to a horizontal surface, such as a table or counter.

It should be appreciated that the present invention provides a holder for heated hair-styling appliances such as curling irons that incorporates heat dissipating air-cooling channels to direct air flow between the liner and the housing so that the exterior surface of the housing remains cool to the touch. Additional objectives, advantages, features and application possibilities of the present invention ensue from the description below of an embodiment referring to the drawings. In this context, all the described and/or depicted features, either on their own or in any meaningful combination, constitute the subject matter of the present invention, also irrespective of their compilation in the claims or the claims to which they refer.

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

It also should be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

The present invention will be described in detail by way of examples with reference to the attached drawings. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s). The following description is provided to enable any person skilled in the art to make and use the invention and sets forth the best modes contemplated by the inventors of carrying out their invention. Various modifications, however, will remain readily apparent to those skilled in the art without departing from the spirit and scope of the invention, which is defined by the accompanying claims.

Figure 3:
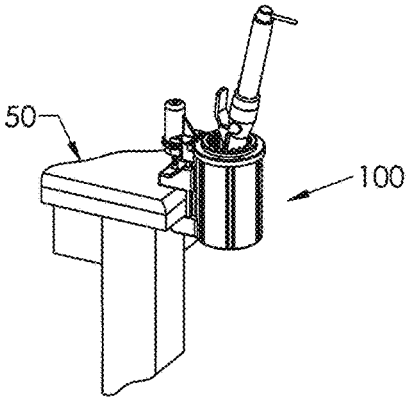
FIG. 3 is a left top perspective view of the first embodiment of the holder of FIG. 1 showing the holder clamped to a tabletop.
Figure 11:
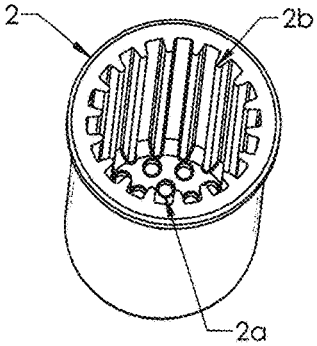
FIG. 11 is a top front perspective view of the liner component of the holder of FIGS. 9 and 10, showing ribs of the inner sidewall of the liner and bottom holes therein utilized in all embodiments illustrated in this disclosure.

Referring now to the drawings, wherein the depictions are for purposes of illustrating embodiments of the subject matter herein only and not for limiting the same, FIGS. 1-3, 18 and 19 show an illustrative view of a first embodiment of the hair styling appliance holder 100. In FIGS. 1 and 3, a hair curling iron 18 is positioned within the holder assembly. This first embodiment of the holder assembly is designed to be clamped to a table or countertop surface. The holder assembly comprises a main housing 6 and a liner 2 held within the housing 6. The liner 2 is a generally cylindrical cup with a bottom, a sidewall and a top flange 2*c*. The top flange 2*c* (see FIGS. 18 and 19) seats on the housing lid 4. As shown in FIG. 11 a series of spaced apart ribs 2*b* are provided on the inner sidewall of the liner 2. A plurality of holes 2*a* are formed in the bottom wall of the liner 2. The liner 2 preferably is constructed of silicone. The liner 2 can be made of any high temperature resilient heat insulating material like silicone, silicone rubber, fiberglass, ceramic, etc. The housing 6 may be made from plastic, wood or metal.

The tip of the curling iron 18 will rest on the inside bottom surface of the liner 2, and the hot wand portion of the curling iron 18 may rest on the inside top ribs 2*b* of liner 2 thereby limiting direct contact by the hot surface of the curling iron 18 to the liner 2. The ribs 2*b* of liner 2 allow air to flow around the curling iron through the gaps between the ribs 2*b*, further enhancing the ability to cool the area surrounding the hot curling iron 18. Limiting the direct contact of the heated wand portion of the curling iron 18 to such contact with the liner 2 reduces the heat transfer through the liner 2 thus to the housing 6 and outer surfaces of the housing 6.

In some instances, the very tip of the curling iron 18 has a cap on it that is not heated and thus does not directly transfer heat to the bottom inside surface of the liner 2. If a cap is present, the heating zone of the curling iron 18 is typically above this cap and up to but not to the handle/control area of the iron.

Figure 2:
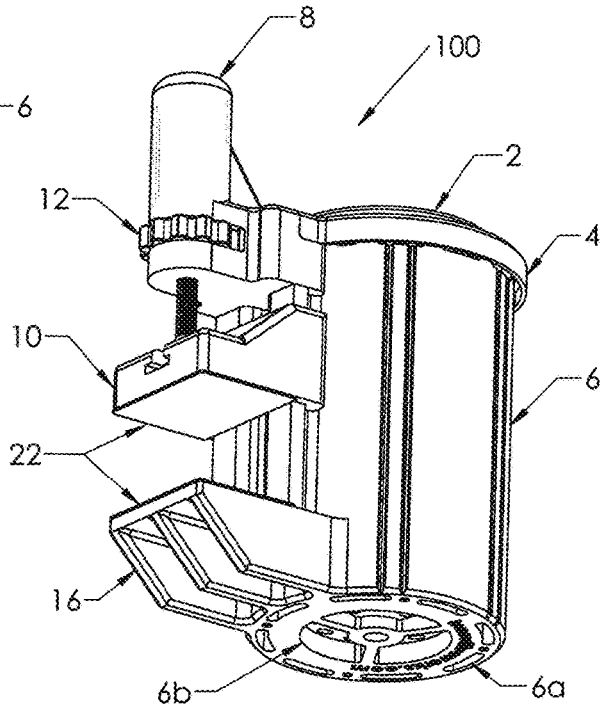
FIG. 2 is a left bottom perspective view of the first embodiment of the holder of FIG. 1 showing bottom vents and clamp detail.
Figure 19:
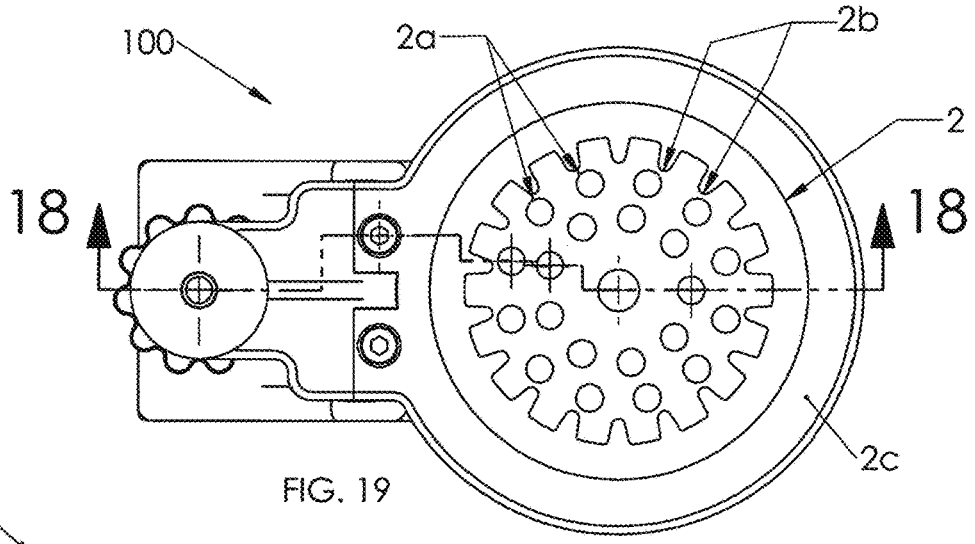
FIG. 19 is a top view of the first embodiment of a holder for a hair styling appliance of FIG. 1.
Figure 18:
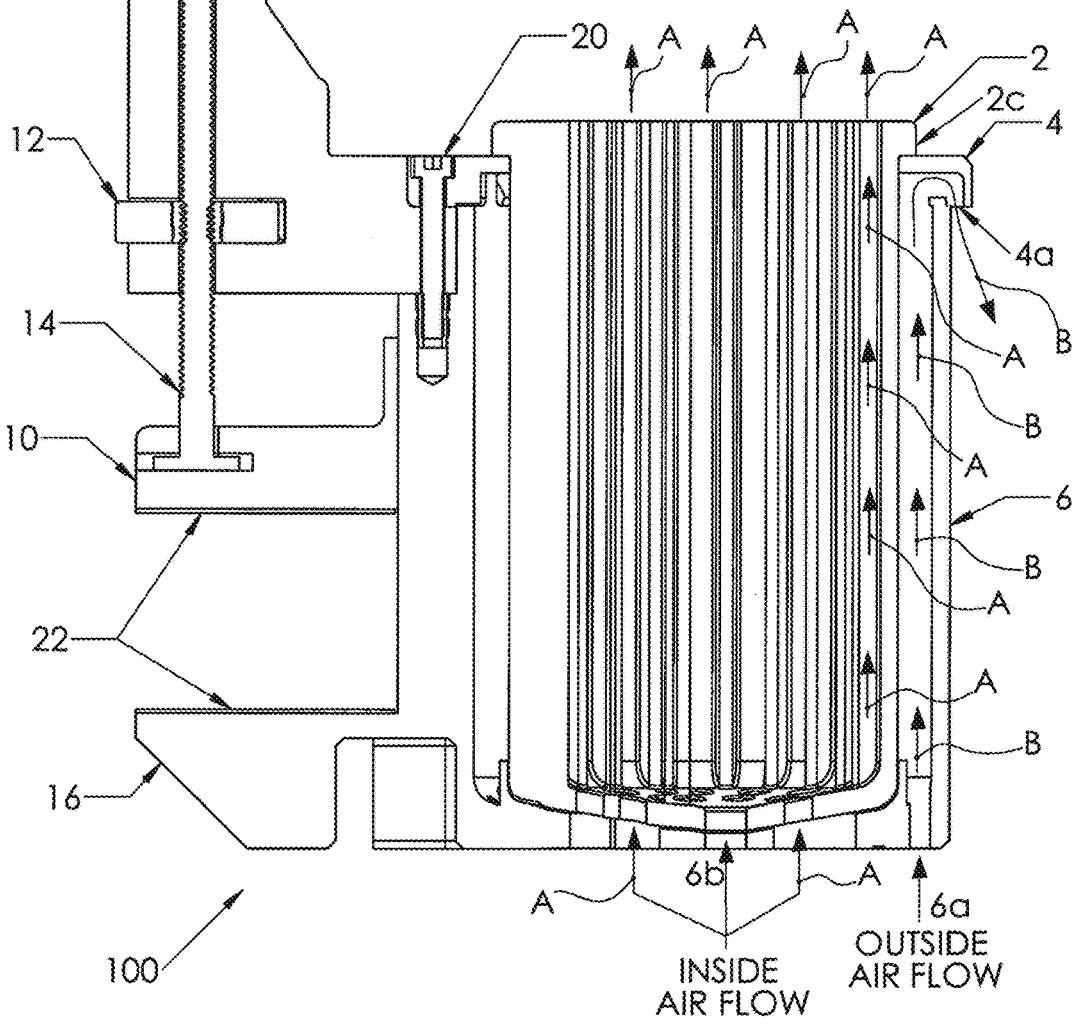
FIG. 18 is a sectional view taken along line 18-18 of FIG. 19 showing enlarged detail of air-cooling channels between the liner and the housing of the first embodiment of the holder of FIG. 1.

FIG. 2 shows a perspective of the holder clamping features for clamping the holder to a surface, FIG. 19 shows a top view of the holder 100, and FIG. 18 shows a cross-section of the holder 100. The clamping features include a surface clamping jaw 10 with opposed flat clamping surfaces that each have a non-slip surface 22. The non-slip surface may comprise a coating or an applied tape or pad layer, such as an adhesive backed urethane resilient pad (Reference 3M™ Bumpon™ Resilient Roll stock). The clamping features further include a protective handle 8, a T-bolt 14 received within a channel of the protective handle 8, and a tightening wheel 12 that advances the T-bolt 14 and thereby indexes the top clamping surface toward or away from the bottom clamping surface. In this embodiment, the bottom clamp plate 16 is stationary and the top clamp plate 10 of the clamping jaw 10 translates up and down as the T-Bolt 14 is advanced by the wheel 12. The clamping features may be removably attached to the housing 6 of the holder 100 with screw connection 20 (see FIG. 18).

FIG. 3 shows the holder 100 with the integrated clamping features having been secured to a tabletop 50. This mounting to a tabletop edge isolates the heat of the curling iron 18 so that the mounting surface is not damaged or marred or scorched by the heated curling iron 18 held in the holder 100.

As best shown in FIGS. 2 and 18 and 19, the housing 6 defines inner channel vents 6*b* to permit air to flow from the environment below the housing 6 and into the liner 2 interior. The liner 2 defines holes 2*a* within the bottom wall of the liner 2 that receive air from the inner channel vents 6*b*. The liner 2 has projecting ribs 2*b* on the inside surface of the liner 2 that establish spaces or air channels therebetween that receive a fluid such as air from the inner channel vents 6*b*. Air flowing into the inner channel vents 6*b* thus is directed into the holes 2*a* and the spaces between the ribs 2*b* and flows around the curling iron 18 when the curling iron 18 is held within the holder 100. Such air flow depicted by arrows A in FIG. 18 draws heat away from the curling iron 18 and away from the liner 2.

The housing 6 further defines one or more outer fluid flow (e.g., air flow) channel vents 6*a* through which air from the environment outside of the holder 100 enters and flows between the exterior surface of the liner 2 and the inner surface of the housing 6. Such air flow depicted by arrows B in FIG. 18 is directed through the outer channel vents 6*a* to draw heat away from the liner 2. The air flow exits from the housing 6 through a passage 4*a* created between the housing lid 4 and the sidewall of the housing 6. The housing top rim or lid 4 could have vents therein at the top surface instead of under the overhang of the lid 4*a* as shown in FIG. 18.

Figure 5:
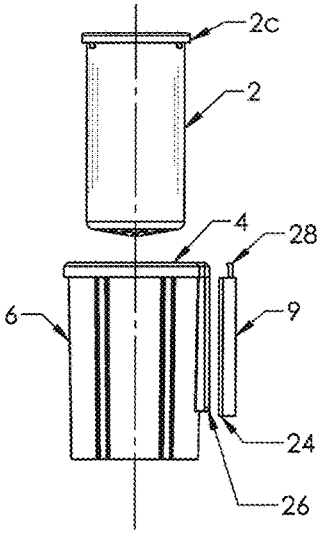
FIG. 5 is a left side exploded view of the second embodiment of the holder of FIG. 4 showing orientation of component parts thereof.

Referring next to FIGS. 4-8, a second embodiment of the holder 200 for a heated hair styling appliance is mountable to a vertical wall surface 60 directly via a bracket 9 as shown in FIGS. 5 (exploded view) and 4. The housing 6 and the liner 2 are of a same or similar construction as shown in the first embodiment of FIGS. 1-3, 18 and 19. The housing 6 receives the liner 2 therein. The liner 2 defines holes 2*a* through the bottom surface and defines ribs 2*b* that project inwardly from the sidewall of the liner 2.

Figure 6:
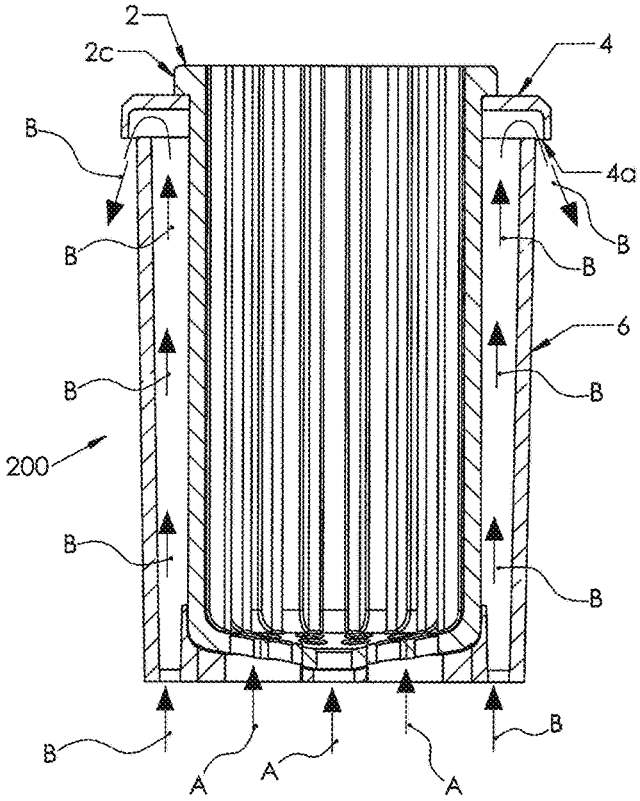
FIG. 6 is a sectional view of the holder taken along line 6-6 of FIG. 8 showing the fluid space to receive a fluid (such as air) established between the liner and the housing of the holder, as well as the fluid flow passages into the inner volume of the liner.

FIG. 6 (a cross section) shows how the liner 2 incorporates a flange 2*c* to seat on the housing lid 4. The sectioned view of FIG. 6 also shows the air flow paths B along the channel between the housing 6 and the liner 2 and the exiting vents under the overhang 4*a* at the housing top 4. The vents 6*a* as best shown in FIG. 7 allow the convection flow of air between liner 2 and housing 6 to exit the holder 200 and thereby draw heat away from the liner 2.

Figure 7:
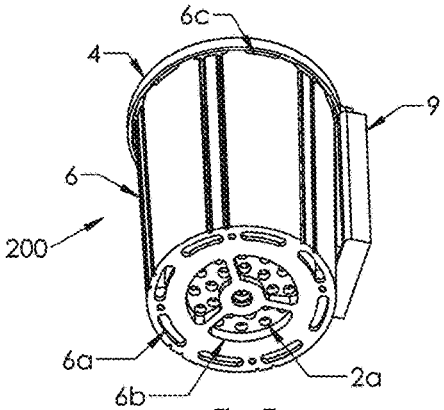
FIG. 7 is a left bottom perspective view of the second embodiment of the holder of FIG. 4 showing vent openings in the bottom of the housing and vent holes in the liner of the holder.
Figure 9:
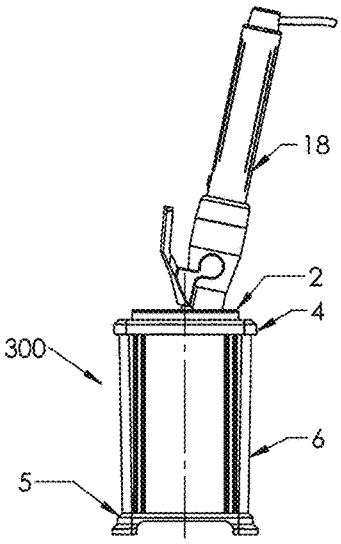
FIG. 9 is a left side view of a third embodiment of a holder for a hair styling appliance, with a curling iron positioned therein, said third embodiment comprising a stand adapted for supporting the holder on a tabletop or countertop.

FIG. 7 shows the perspective view of housing 6 from the bottom and the vents 6*a* which allows for the airflow depicted by arrows B to the channels between the liner 2 and housing 6. This figure also shows the region beneath the housing lid top 4 and housing 6 where the upper vents 6*c* are located (beneath the overhang of the housing lid top 4). FIG. 7 further shows the vents 6*b* through which airflow depicted by arrows A (see FIG. 6) may flow to the holes 2*a* and the channels between the ribs 2*b* of the liner 2 held inside the housing 6. Such airflow also draws heat away from the liner 2 and away from the curling iron 18 held in the liner 2.

Figure 8:
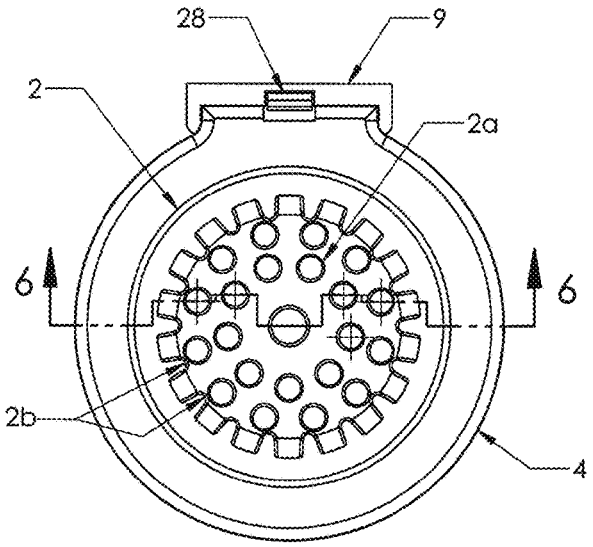
FIG. 8 is a top view of the second embodiment of the holder, depicting the liner in the housing and showing particularly the ribs and bottom holes of the liner.
Figure 4:
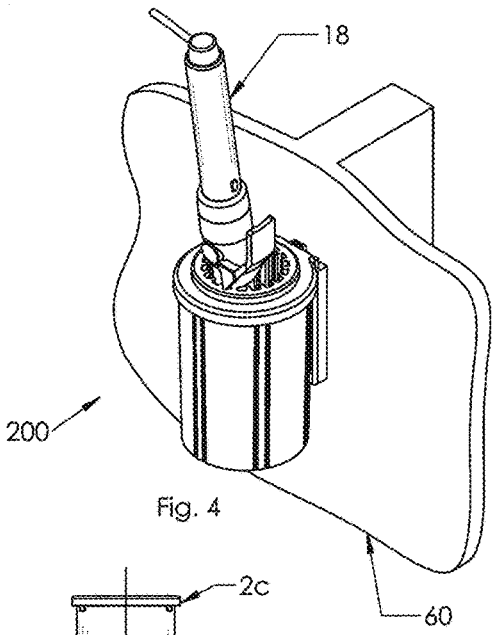
FIG. 4 is a right top perspective view of a second embodiment of a holder for a hair styling appliance, with a curling iron positioned therein, said second embodiment incorporating a wall mount structure so that the holder is mountable to a vertical wall surface, as shown.

FIG. 8 shows the top view of the holder for a hair styling appliance of the second embodiment (for wall mounting) with the liner 2 housing top 4 and its features that enhance cooling and minimize heat transfer, incorporating holes 2*a* in the bottom of the liner 2 that allow airflow (depicted by arrows A), as well as ribs 2*b* limiting contact of the hot surface of the curling iron.

As shown in FIGS. 5 and 8, the wall mounting bracket 9 has a grooved surface 24 configured to receive a mating elongated projection 26 extending from the outer sidewall of the housing 6. In this configuration, the elongated projection 26 slidably engages with the grooved surface 24 and is secured for retention therein by a top detent 28.

Figure 12:
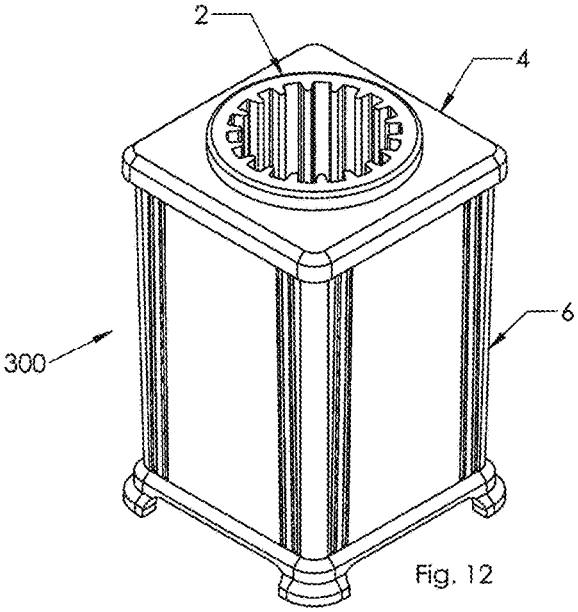
FIG. 12 is a right front perspective view of the third embodiment of the holder for a hair styling appliance.
Figure 13:
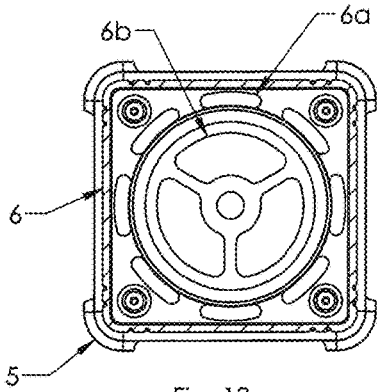
FIG. 13 is a bottom view of the third embodiment of the holder for a hair styling appliance, showing particularly the bottom of the housing and the vents therein.

FIGS. 9-14 illustrate a third embodiment of a hair styling appliance holder 300. In the third embodiment the holder 300 can be placed on a horizontal surface, such as a countertop or a tabletop. The holder 300 receives the curling iron 18 within the liner 2 of the housing 6. In this third embodiment, the housing 6 has four side walls forming a square post shape that is supported by legs 5 to create a standoff from any horizontal surface upon which the holder 300 is positioned. The legs 5 have a height to establish an air gap below the bottom surface of the housing 6 to ensure that air can still reach the vents 6*a* and 6*b* which operate in the same manner as the vents 6*a*, 6*b* described above with respect to FIGS. 6 and 14. The vents 6*a*, 6*b* for this third embodiment are shown in FIG. 13.

In an advantageous variation of the third embodiment of the holder 300, the base 5 could be made of metal to add weight to enhance stability of the holder 300.

FIG. 12 shows a perspective view of the third embodiment of the holder 300 with the housing 6 and the vented top 4 and liner 2.

Figure 14:
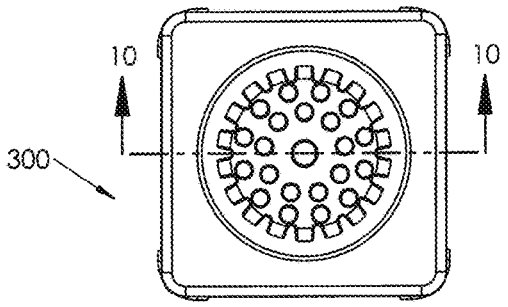
FIG. 14 is a top view of the third embodiment of the holder for a hair styling appliance, showing particularly the ribs and bottom holes of the liner.
Figure 10:
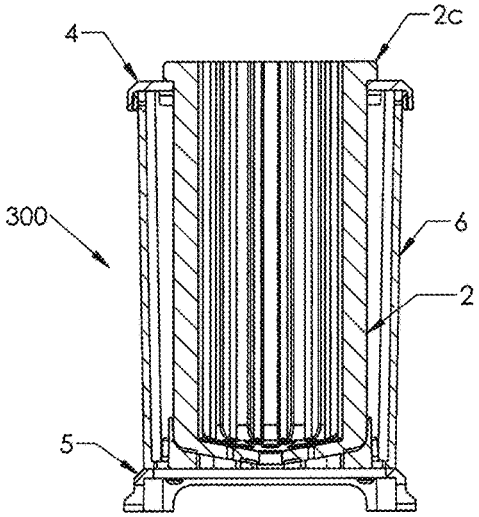
FIG. 10 is a sectional view of the holder taken along line 10-10 of FIG. 14, showing the air channel established between the liner and the housing of the third embodiment of the holder.

FIG. 10 shows a cross section of the holder 300 taken along line 10-10 in FIG. 14. In FIG. 10, the air channels between liner 2 and housing 6 for this tabletop version, as well as the vented top 4, can be seen. FIG. 10 also shows the base with legs 5 to create a standoff from a surface to allow fluid flow (e.g., air flow) beneath holder 300 when placed on a horizontal surface, such as a tabletop or countertop.

FIG. 11 shows the liner 2 in a top perspective view without the housing. In FIG. 11, the holes 2*a* through the bottom wall of the liner 2 and the ribs 2*b* projecting inwardly from the inner surface of the liner 2 can be seen more readily. FIG. 13 shows the bottom of the holder 300 with the housing 6 having vents 6*a* and 6*b* that support the flow of air into the channels between the liner 2 and the housing 6 as well as through the holes 2*a* in the liner 2. FIG. 14 shows the top view of the holder 300 of the third embodiment with the liner 2 held in the housing 6.

Figure 15:
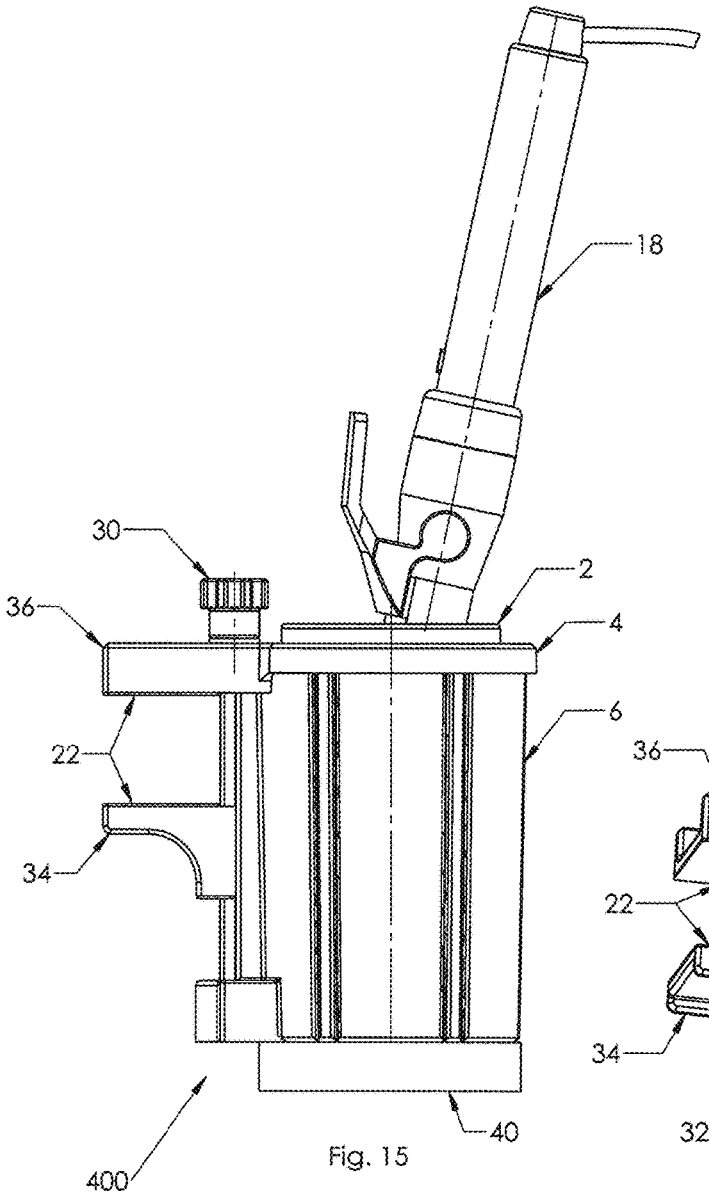
FIG. 15 is a left side view of a fourth embodiment of a holder for a hair-styling appliance, with a curling iron positioned therein, said fourth embodiment incorporating an alternate clamp so that the holder may be clamped to a table.
Figure 17:
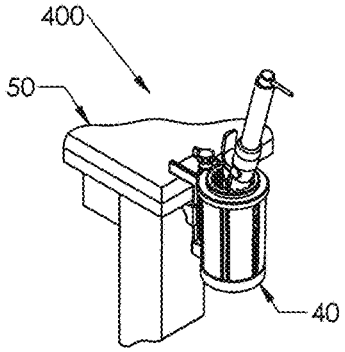
FIG. 17 is a left top perspective view of the fourth embodiment of the holder of FIG. 15 showing the holder clamped to a tabletop.
Figure 16:
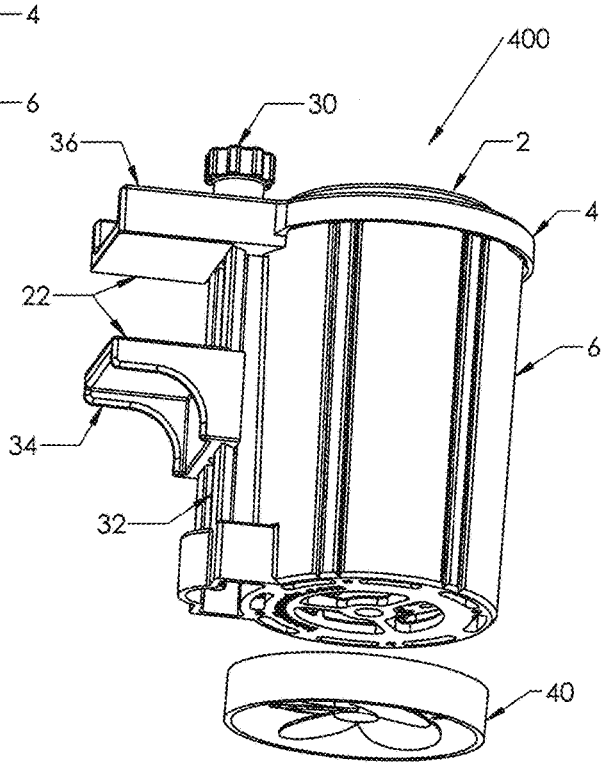
FIG. 16 is a left bottom perspective view of the fourth embodiment of the holder of FIG. 15 showing bottom vents and clamp detail with optional forced induction module, such as a fan.

Referring next to FIGS. 15-17, an illustrative view of a fourth embodiment of the hair styling appliance holder 400 is shown. In FIGS. 15 and 17, a hair curling iron 18 is positioned within the holder assembly. This fourth embodiment 400 of the holder assembly is designed to be clamped to a table or countertop surface 50. Comparable to the holder 100 shown in FIG. 1, the holder assembly of the fourth embodiment 400 comprises a main housing 6 and a liner 2 held within the housing 6. The configuration of the liner 2 and the housing 6 is substantially the same as shown in FIGS. 1-3, except that the fourth embodiment 400 of the holder has a different clamping mechanism and includes an optional fan 40 or blower to force fluid flow into one or more of the vent openings 6*a*, 6*b* defined by the housing. The liner 2 preferably is constructed of silicone. The liner 2 can be made of any high temperature resilient or high heat insulative material like silicone, silicone rubber, fiberglass, ceramic, etc. The housing 6 may be made from plastic, wood or metal.

FIG. 16 shows a perspective view of the holder clamping features for clamping the holder 400 to a surface, and FIG. 17 shows the holder 400 with a curling iron 18 therein clamped to a horizontal surface. The clamping features of this embodiment include surface clamping jaws 34, 36 with opposed flat clamping surfaces that each have a non-slip surface 22. The non-slip surface may comprise a coating or an applied tape or pad layer, such as an adhesive backed urethane resilient pad (Reference—3M™ Bumpon™ Resilient Roll stock The top clamp plate 36 is stationary and the bottom clamp plate 34 translates up and down as the tightening wheel 30 of the bolt 32 is turned. The tightening wheel 30 rotates the bolt 32 and thereby indexes the bottom clamping plate 34 surface toward or away from the top clamping plate 36 surface. The clamping features may be removably attached to the housing 6 of the holder 400 with a screw connection, or the top clamping plate 36 may be monolithically formed together with the housing or with the housing lid 4.

FIG. 17 shows the holder 400 with the alternative integrated clamping features having been secured to a tabletop 50. This mounting to a tabletop edge isolates the heat of the curling iron 18 so that the mounting surface is not damaged or marred or scorched by the heated curling iron 18 held in the holder 400.

An optional force induction module or fan unit 40 is shown adjacent to the bottom surface of the housing 6 in FIGS. 15-17. The fan unit 40 blows or forces fluid, such as air, into the vent openings 6*a*, 6*b* through the housing 6 and into the fluid receiving space between the housing 6 and the liner 2, and into the holes 2*b* formed in the bottom of the liner 2. Representative fluid flow (air flow) is depicted by arrows A and B in FIG. 18. In an alternative configuration, the fan unit 40 could be installed inside the housing 6 below the bottom wall of the liner 2. In such configuration, the fan unit then draws air into the housing through the vent openings 6*a*, 6*b*.

While FIG. 18 is the cross-section for the first embodiment of the holder 100 shown in FIG. 1, FIG. 18 illustrates the typical fluid flow paths A which is through the bottom of housing 6 and up through liner 2 and B for the channel of air between the liner 2 and the housing 6 that are incorporated into all the holders 100, 200, 300 and 400 shown in FIGS. 1, 4, 9, and 15. The primary air path(s) A surrounding the hot curling iron 18 will rise out of the top opening in the liner 2. The hot rising air will pull cooler air through the vents 6*b* in the housing 6 bottom and that air will flow via flow path(s) A around the outside of the curling iron and out the top opening in the liner 2. A second air flow channel is established up through the outer vents 6*a* of the housing 6 bottom and then up through the inside channel created by the outside of the liner 2 and the inside of the housing wall 6, then out vents 6*c* shown in FIG. 7 in the upper side wall of the housing which are located under the overhanging top of housing 4. Allowing this fluid flow of air via flow path(s) B through the holder 100, 200, 300, 400 helps to cool the liner 2 and the housing 6, thereby insulating the housing from the hair styling appliance (curling iron 18) held in the liner 2 and lowering the temperature of the external surfaces of the housing 6. This cooling effect minimizes risk of harm to a user, such as by burning when touching the housing. The housing 6 exterior surface remains cool enough to be touched even while a hot curling iron 18 is present within the holder 100, 200, 300, 400.

In an advantageous variation, the housing top rim or lid could have vents therein at the top surface instead of under the overhang of the lid as shown in FIGS. 6 and 18.

While the liner 2 is shown as a circular cylindrical cup, alternatively, the cup shaped liner 2 could be formed as a cup with a different configuration, including but not limited to, square, rectangular, round, octagonal, oblong or oval. The liner 2 can be sized to retain or store other hot tools used in hair styling besides curling irons, including but not limited, to flat irons used for hair straightening. The liner 2 can be sized to retain or store two or more hair styling appliances or hot tools at a same time.

While the housing 6 is shown advantageously clamped to a counter or table edge 50 in the FIGS. 3 and 17 herein, the housing 6 alternatively could instead have a bracket incorporated into the housing design enabling the holder 6 to be wall mounted. One embodiment showing a bracket 9 for a wall mounted holder 6 is shown in FIGS. 4-8.

One embodiment showing a holder 300 with a housing 6 that is formed with legs 5 to create a base or stand to receive the liner 2 and thereby support the liner 2 on a horizontal countertop or table top surface is shown in FIGS. 9-13, described as the third embodiment. Another option is to incorporate a base with legs on the bottom of the housing 6 of either the first embodiment or the second embodiment so that the housings of these embodiments alternatively could be placed on a countertop or table top (without clamps or brackets), while still allowing air to flow through the vents provided through a portion of the bottom of the housing.

In an exemplary embodiment, the cup shaped liner may have a cylindrical configuration with an inner diameter of about 1.25 inches or larger and an outer diameter of at least about 0.1 inches greater than the inner diameter. The cup shaped liner may have a height of at least about 3 inches. The series of holes in the bottom of the cup shaped liner may have hole diameters of about 0.05 inches or greater. In an exemplary embodiment, the cup shaped liner has at least two holes in the bottom wall of the cup, and a flange surrounds the top rim of the cup.

The cup shaped liner may have a configuration that is round, rectangular, square, octagonal or oval, or any other geometric shape. The liner may have one sidewall or multiple sidewalls.

The cup shaped liner may have ribs projecting from its inner surface into the interior volume of the cup shaped liner. The ribs may project a distance of about 0.10 inches or greater from the inner wall. Alternatively, the cup shaped liner may have ribs projecting from its outer surface (radially away from the outer surface). The outwardly projecting ribs may project a distance of about 0.10 inches or greater. Optionally, the liner may be provided with both inwardly directed ribs and outwardly directed ribs.

In an exemplary embodiment, the housing may have a cylindrical configuration such that the housing inner wall that surrounds the outer diameter of the cup shaped liner has an inner diameter that is about 0.10 inches greater than the outer diameter of the cup shaped liner. The housing is provided with at least one vent hole in the bottom wall that can be placed in fluid communication with the vent holes of the cup shaped liner to be held in the housing. The housing gap between the liner and the housing of this exemplary embodiment directs air flow to a vent opening established outside of the liner and inside the housing wall.

The housing may have a configuration that is round, rectangular, square, octagonal, or oval, or any other geometric shape. The housing may have one sidewall or multiple sidewalls. The configuration of the liner does not have to match the configuration of the housing. One nonlimiting example is shown in FIGS. 9-14, where the housing has four sidewalls and forms a square post, whereas the liner has a generally cylindrical shape with a single sidewall.

In another exemplary embodiment, the housing may include top vents that are any suitable geometrical shape, including but not limited to rectangularly shaped, with dimensions of about 0.04 inch by 0.04 inch. The housing lid may have an overhang of greater than 0.05 inches.

In still another exemplary embodiment, the housing may have legs extending from a base. The legs of this embodiment allow an offset from the supporting surface of greater than 0.1 inches to allow fluid flow (e.g., air flow) beneath the housing when the housing is supported on the supporting surface.

While not wishing to be bound by one particular theory, we believe our invention overcomes the problems encountered with prior curling iron holders and stands because specific cooling paths and isolation are implemented to protect the user as well as the surroundings (countertops, tabletops, and walls within the styling space). Prior holders and stands failed to do a good job of protecting the user, and more specifically, did not provide good protection to the surrounding environment, like the countertop onto which curling irons are typically placed, exposing the radiant heat of the iron onto the surface and leading to damage to that surface. The approaches that employed metal holders still allowed the metal surface to get hot and create a risk of a burn to the user. Moreover, other people nearby may be unaware that a curling iron is hot and could touch the hot curling iron that is resting on a stand or on a surface within the home. Our invention eliminates those risks to the user and the surrounding environment with the combined use of the silicone liner that defines air channels allowing air flow to cool the curling iron, and the outer housing spaced around the silicone liner with air channels keeping the outer housing insulated from the liner and therefore retaining the housing at lower temperatures, thus minimizing the impact that the hot curling iron has on both user and surrounding surfaces.

Our invention provides several possible uses as a hair-styling appliance holder. The embodiments illustrated herein show a curling iron held within the holder, but our holder is suitable for other heated hair-styling appliances. The holder can be mounted conveniently on a wall, counter or tabletop, and is especially convenient in tight spaces such as recreational vehicles or bathrooms with reduced counterspace. The holder offers the ability to withstand high temperatures, enabling the use of a hot curling iron or other appliance safely. Users conveniently may reposition the holder even while the holder retains the hot hair-styling appliance therein without risk of injury.

REFERENCE NUMERALS

2—silicone cup shaped liner
2*a*—holes within the bottom of the silicone liner
2*b*—ribs on inside surface of the silicone liner
2*c*—Flange at top of silicone liner
4—housing lid
4*a*—housing lid overhang gap
5—base with legs
6—main housing
6*a*—bottom housing outer channel vents
6*b*—bottom housing inner liner vents
6*c*—housing upper channel vents
8—protective handle
9—bracket
10—surface movable clamping jaw
12—tightening wheel
14—T-Bolt
16—stationary clamp plate
18—curling iron
20—screw hardware
22—nonslip surface
24—groove in bracket for wall mounting
26—mating slide to fit in groove
28—detent clasp
30—tightening wheel
32—bolt
34—movable clamp plate
36—stationary clamp plate
40—fan unit
50—horizontal support surface-tabletop or countertop
60—vertical support surface-wall
100—holder
200—holder
300—holder
400—holder

What is claimed is:

1. A hair appliance holder, comprising:

at least one cup shaped liner having a sidewall with an inner surface and an outer surface, a flange protruding or extending outward from a top portion of the sidewall, and a bottom wall, wherein the bottom wall defines two or more holes therethrough establishing fluid flow communication into an internal volume of the at least one cup shaped liner;

a housing surrounding the at least one cup shaped liner, the housing having at least one housing sidewall and a housing bottom wall, wherein the housing sidewall has an inner surface and an outer surface and the inner surface is spaced apart from the outer surface of the at least one cup shaped liner creating a fluid receiving space, wherein the housing bottom wall defines at least one vent opening sufficiently aligned with at least one of the two or more holes of the at least one cup shaped liner to define a fluid passage into the internal volume of the cup shaped liner, and wherein the housing bottom wall defines at least one other vent opening sufficiently aligned with the fluid receiving space between the outer surface of the at least one cup shaped liner and the inner surface of the housing sidewall to define a second fluid passage; and a lid overlying a top of the sidewall of the housing.

2. The holder of claim 1, wherein the lid defines an opening to receive the cup shaped liner, and the flange of the cup shaped liner seats over at least a portion of the lid.

3. The holder of claim 1, wherein the lid has one or more vent openings communicating with the second fluid passage.

4. The holder of claim 1, wherein the housing sidewall has one or more vent openings communicating with the second fluid passage.

5. The holder of claim 1, further comprising:

a plurality of ribs projecting from the inner surface of the at least one cup shaped liner and establishing fluid flow channels therebetween, wherein the fluid passage communicates with at least some of the fluid flow channels between the ribs.

6. The holder of claim 1, further comprising:

a plurality of ribs projecting from the outer surface of the at least one cup shaped liner and establishing fluid flow channels therebetween, wherein the at least one other vent opening in the housing is sufficiently aligned with the fluid receiving space between the outer surface of the cup shaped liner and the inner surface of the housing sidewall so that the second fluid passage communicates with at least some of the fluid flow channels between the ribs.

7. The holder of claim 1, wherein the cup shaped liner is formed of a high temperature resistant insulative material.

8. The holder of claim 7, wherein the high temperature resistant insulative material is selected from the group consisting of: silicone, silicone rubber, fiberglass, and ceramic.

9. The holder of claim 1, wherein the housing is formed from a material selected from the group consisting of: silicone, plastic, metal and wood.

10. The holder of claim 1, further comprising a mounting feature to removably clamp the holder to a surface.

11. The holder of claim 10, wherein the mounting feature is either integrally formed with the housing or is removably attachable to the housing.

12. The holder of claim 10, wherein the mounting feature has opposing clamp plates with clamp plate surfaces, and the clamp plate surfaces are covered with or coated with a nonslip surface.

13. The holder of claim 1, further comprising a mounting feature to removably attach the holder to a vertical surface.

14. The holder of claim 13 wherein the mounting feature is either integrally formed with the housing or is removably attachable to the housing.

15. The holder of claim 13, wherein the housing bottom wall is supported by a base and wherein the mounting feature is attached to or removably attachable to the base.

16. The holder of claim 1, further comprising legs extending from the housing bottom wall, wherein said legs support the holder on a horizontal surface and establish an airspace between the bottom of the housing and the horizontal surface.

17. The holder of claim 16, wherein the housing bottom wall is supported by a base and the legs extend from the base.

18. The holder of claim 1, further comprising a hair appliance, wherein the hair appliance is selected from the group consisting of: a curling iron, a hair straightener, a styling iron, a blowout brush, a hair waver and a hair dryer.

19. The holder of claim 1, further comprising a fan or blower to force fluid flow into one or more of the vent openings defined by the housing.

* * * * *